US007437982B2

(12) United States Patent
Spirito et al.

(10) Patent No.: US 7,437,982 B2
(45) Date of Patent: Oct. 21, 2008

(54) UNIT FOR FEEDING AND CUTTING INTO LENGTHS A STRIP OF WRAPPING MATERIAL

(75) Inventors: Gilberto Spirito, Bologna (IT); Alessandro Minarelli, Bazzano (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 11/100,399

(22) Filed: Apr. 7, 2005

(65) Prior Publication Data

US 2005/0223861 A1 Oct. 13, 2005

(30) Foreign Application Priority Data

Apr. 8, 2004 (IT) ..... BO2004A0201

(51) Int. Cl.
*B23D 25/12* (2006.01)

(52) U.S. Cl. ..... 83/343; 83/288; 83/678

(58) Field of Classification Search ..... 83/343, 83/302, 287, 288, 324, 678, 679; 493/63
See application file for complete search history.

(56) References Cited

U.S. PATENT DOCUMENTS 2,305,428 A * 12/1942 Johnson ..... 206/264
3,369,436 A * 2/1968 Louse ..... 83/324
3,410,162 A * 11/1968 Ruggeri ..... 83/100
3,531,035 A 9/1970 Maynard et al.
3,628,410 A * 12/1971 Shields ..... 83/287
3,855,890 A * 12/1974 Lynch et al. ..... 83/331
4,114,355 A * 9/1978 Davies et al. ..... 53/389.3
4,351,142 A * 9/1982 Focke et al. ..... 53/575
4,964,324 A * 10/1990 Pavlick ..... 83/302
5,179,815 A * 1/1993 Cahill et al. ..... 53/133.3

(Continued)

FOREIGN PATENT DOCUMENTS

EP 0443787 8/1991

(Continued)

OTHER PUBLICATIONS

Awaken the Design Animal Inside You! Foil Stamping and Embossing Association. Viewed Jun. 1, 2006. Google cache at least as early as May 28, 2006 22:15:47 GMT. http://www.fsea.com/bookstore/DesignersGuidebook.asp.*

(Continued)

*Primary Examiner*—Kenneth E. Peterson
*Assistant Examiner*—Sean Michalski
(74) *Attorney, Agent, or Firm*—Timothy J. Klima

(57) ABSTRACT

A strip of wrapping material is fed and cut into leaves by a unit comprising first and second contrarotating rollers equipped with respective first and second blades of which the first blades operate as a pair to cut the strip transversely into leaves, and the second blades operate as a pair to impress a transverse line on each leaf, this line combining with a longitudinal line, impressed by a further disc cutter, to create a "pull" portion removable from the leaf by tearing. The timing of the second blades can be controlled, so as to adjust the position of the transverse tear-off line on the leaf, by components interacting with the strip along a predetermined feed path extending between two decoiling rollers and a cutting zone that coincides with the line of substantially tangential proximity between the two cutter rollers.

20 Claims, 5 Drawing Sheets

U.S. PATENT DOCUMENTS

| | | | | |
|---|---|---|---|---|
| 5,797,305 | A * | 8/1998 | Harrod et al. | 83/37 |
| 5,823,934 | A * | 10/1998 | Ferrone | 493/342 |
| 6,095,959 | A * | 8/2000 | Negrini et al. | 493/58 |
| 6,221,192 | B1 * | 4/2001 | Walsh | 156/257 |
| 6,325,952 | B1 * | 12/2001 | Jarrett et al. | 264/37.3 |
| 6,826,889 | B2 * | 12/2004 | Parker | 53/133.8 |
| 2004/0221700 | A1 * | 11/2004 | Williams et al. | 83/236 |
| 2005/0186009 | A1 * | 8/2005 | Baker et al. | 400/619 |

FOREIGN PATENT DOCUMENTS

| | | |
|---|---|---|
| EP | 1097894 | 5/2001 |
| GB | 2382341 | 5/2003 |

OTHER PUBLICATIONS

Standard Search Report dated Oct. 6, 2004.

* cited by examiner

UNIT FOR FEEDING AND CUTTING INTO LENGTHS A STRIP OF WRAPPING MATERIAL

BACKGROUND OF THE INVENTION

The present invention relates to a unit for feeding and cutting into discrete lengths a strip of wrapping material.

The discrete lengths thus obtained are used in a machine for packaging commodities.

Units of the type in question are used typically to cut a continuous strip of metal foil paper into single leaves, which are then fed to the wrapping unit of a cigarette packer and folded each directly around a respective group of cigarettes to form an inner wrapper in the finished packet.

The leaves of metal foil paper are generated by making transverse cuts through the strip and appear rectangular in outline, the predominating dimension aligned on the axis of the strip. Each single leaf presents a corner area with two tear-off lines, one longitudinal, one transverse, combining to delimit a rectangular portion known as a "pull", which can be removed by the user at the moment of breaking open the packet of cigarettes.

Conventionally, feeding and cutting devices used to generate the single leaves of material comprise a first roller and a second roller rotatable about mutually parallel axes in opposite directions, each of which is equipped with two diametrically opposed blades extending parallel to the axes of rotation.

The first roller has an aspirating cylindrical surface and, besides affording a reaction element in the course of the cutting step, serves also to advance the strip of metal foil paper decoiled from a relative roll, and to convey the leaves separated by the cutting action toward a further processing station.

The two blades of a first pair mounted one to the first roller and one to the second, substantially equal in length to the transverse dimension of the strip, serve to make the cut by which the leaf is separated from the strip. The blades of a second pair serve to impress the transverse tear-off line aforementioned.

Also forming a part of the feeding and cutting device is a disc cutter rotatable about an axis parallel to the axes of the two rollers, operating in combination with the first roller to impress the longitudinal tear-off line aforementioned.

In the conventional feeding and cutting devices thus briefly described, accordingly, the transverse tear-off line occupies an intermediate position, located between and at a set distance from the two shorter cut edges of the rectangular leaf.

It can happen, for example when changing from one type of metal foil strip to another, or changing the arrangement of the rows of cigarettes making up the group, or changing the brand of cigarettes in production, that the longer dimension presented by the removable part of the wrapper needs adjusting in order to avoid any incorrect alignment of the inner wrapper, and more particularly of the pull portion, relative to the group of cigarettes. This same adjustment serves also to avoid damaging the cigarettes through contact with folder mechanisms placed, in the case of the typical wrapping method, to engage the end portions of the flank faces when making the end folds of the inner wrapper.

The object of the present invention is to provide a unit for cutting a strip of wrapping material into discrete lengths such as will be unaffected by the aforementioned drawbacks.

SUMMARY OF THE INVENTION

The stated object is duly realized in a unit for feeding and cutting into discrete lengths a strip of wrapping material, applicable to a machine for packaging commodities and in particular a cigarette packer. Such a unit comprises first cutting means, cyclical in operation, by which a continuous strip is divided up transversely into single leaves of predetermined length, and at least second cutting means, cyclical in operation, serving to impress at least one transverse tear-off line on each leaf; the unit disclosed will also include means by which to control the timing of the stroke made by the second cutting means, relative to the cycle of the first cutting means, between each two successive transverse dividing strokes made through the strip, so as to adjust the position of the transverse tear-off line on the leaf.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
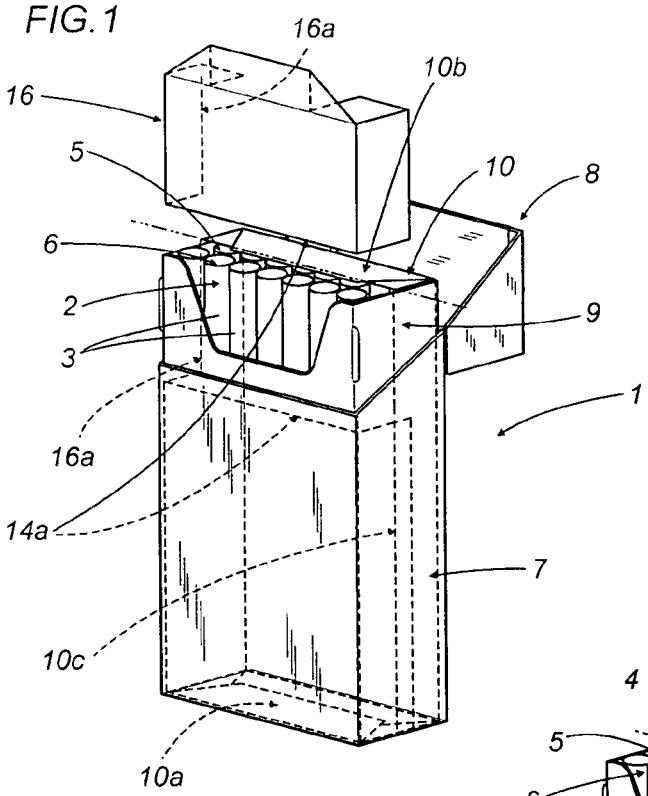
FIGS. 1, 1*a* and 1*b* illustrate an example of a rigid cigarette packet, viewed in perspective from the front in an open configuration, and showing an inner wrapper fashioned from a leaf of wrapping material obtainable with the unit according to the present invention.

Referring to FIG. 1 of the drawings, 1 denotes a packet of substantially parallelepiped appearance with a hinged lid, in its entirety, such as will contain a group 2 of twenty cigarettes 3 ordered in three rows denoted 4, 5 and 6, as viewed from the rear to the front, made up of seven, six and seven cigarettes 3, respectively.

The packet 1 is of conventional type, comprising a cupped body 7 surmounted by a lid 8 hinged to the rear wall of the body 7, also a stiffening frame 9 projecting beyond the open end of the cupped body 7 and functioning as an element by which the lid 8 is guided into a closed position (not illustrated) and retained stably in this same position.

Located internally of the cupped body 7 and in direct contact with the group 2 of cigarettes 3 is an inner wrapper 10 made of a suitable material, preferably metal foil paper. The inner wrapper 10 is fashioned from a leaf 11 of wrapping material obtained from a continuous strip 12 (see FIGS. 2 to 4) by way of transverse cutting steps that will be described in due course.

Figure 4:
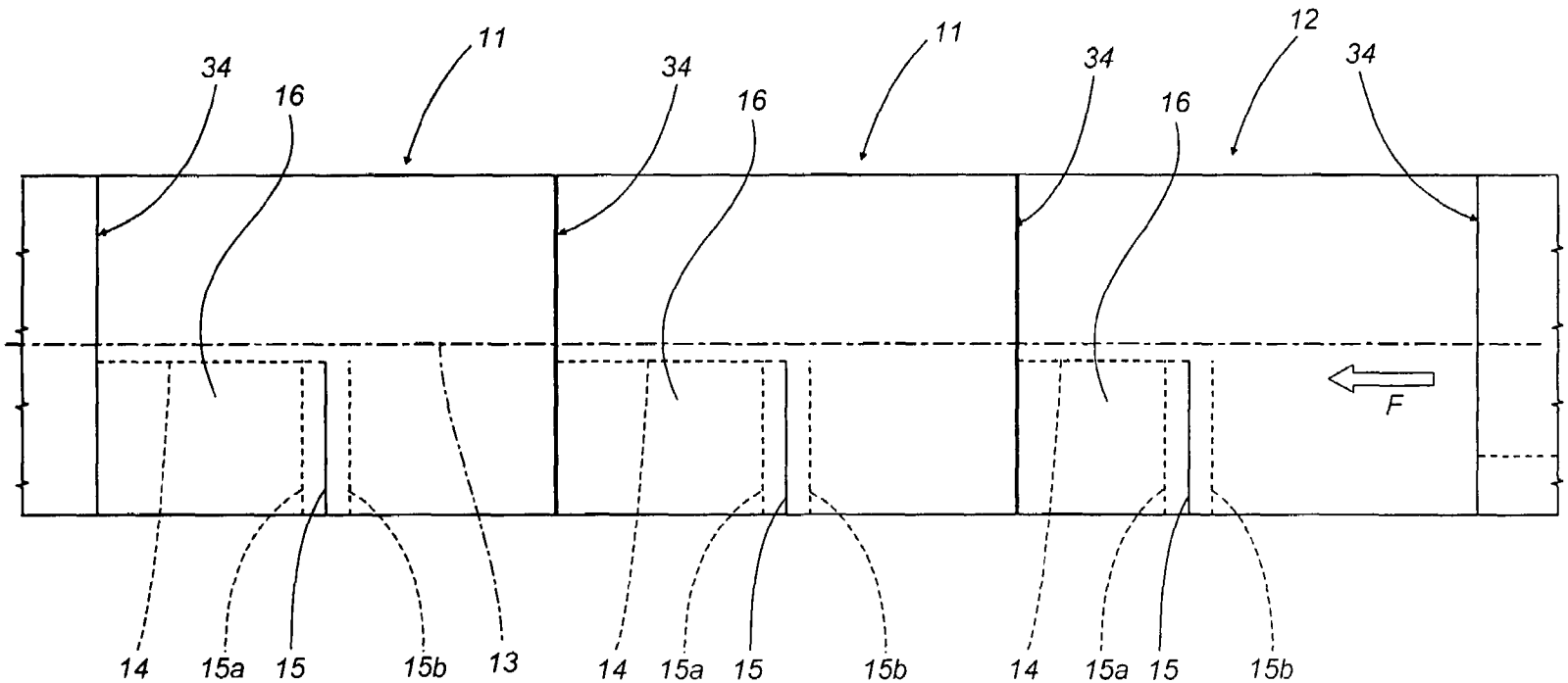
FIG. 4 is a schematic plan view illustrating a strip of wrapping material from which single leaves are obtained.

Referring to FIGS. 1 and 4, the single leaf 11 appears rectangular in outline with a predominating dimension aligned on the longitudinal axis 13 of the strip 12, and includes a corner area presenting two tear-off lines, one longitudinal, denoted 14, the other transverse, denoted 15.

The two lines 14 and 15 in question delimit a rectangular portion 16 commonly referred to as a "pull" and constituting a part of the wrapper that can be removed by the consumer when opening the packet 1 of cigarettes 3. As indicated in FIG. 1, the removal of the portion 16 in question exposes the forwardmost row 6 of the group 2 so that the cigarettes 3 can be taken from the packet 1.

Figure 2:
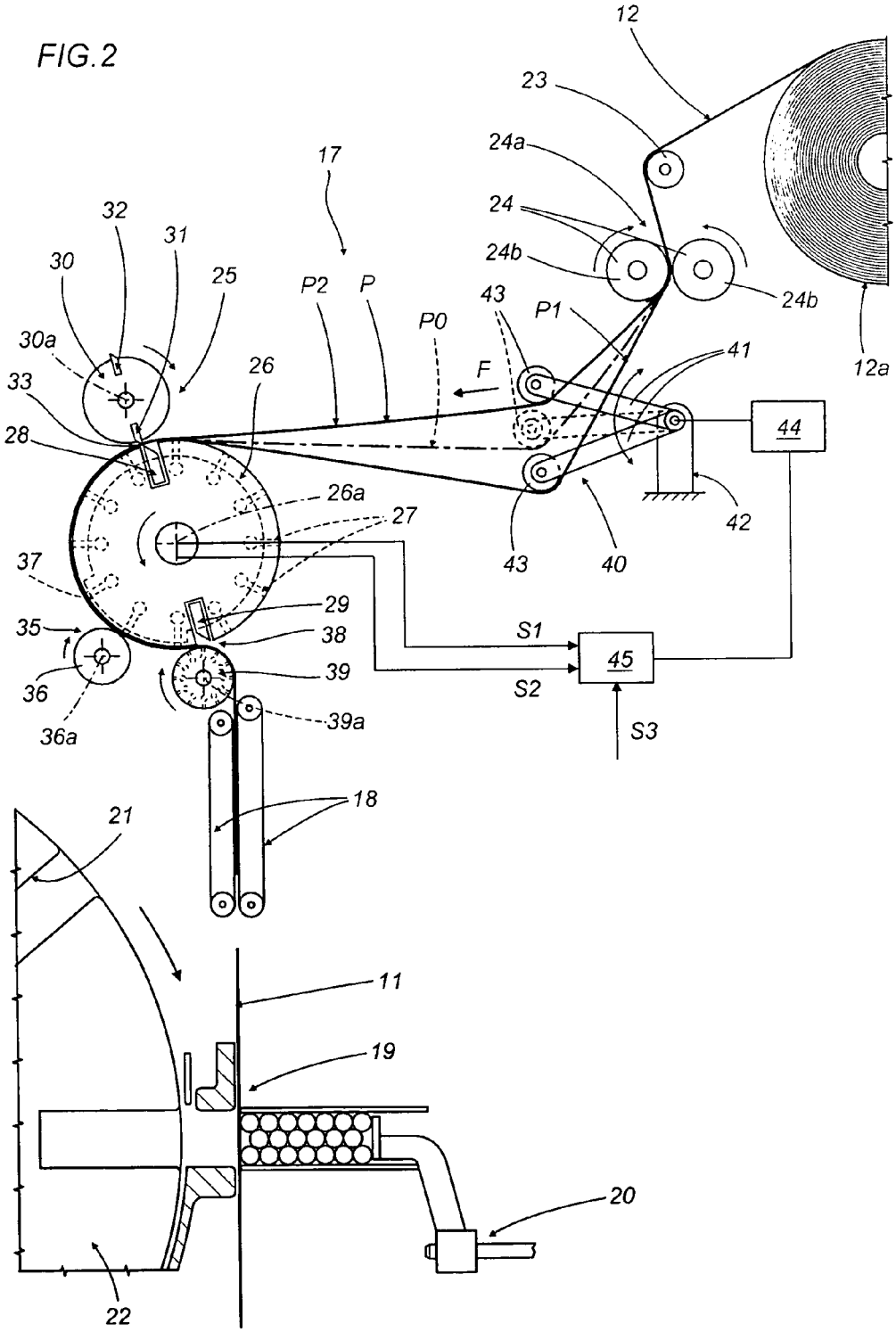
FIG. 2 shows a first embodiment of the unit according to the invention, viewed in a schematic elevation and partly as a block diagram, with certain parts in section and others omitted.

FIG. 2 of the drawings illustrates a feed unit, denoted 17 in its entirety, by which the strip 12 of metal foil paper is decoiled from a roll 12*a* and cut into discrete lengths, or leaves 11.

The leaves 11 are directed through feed and guide means shown schematically as a pair of essentially vertical conveyor belts denoted 18, disposed facing one another on opposite sides of the leaf 11, and advanced toward a first processing station 19 where each successive leaf will be engaged transversely by a respective group 2 of cigarettes and directed together with the cigarettes by the action of a push rod 20 into a relative pocket 21 of a wrapping wheel 22 that forms part of a cigarette packer not illustrated in the drawings.

As the group 2 of cigarettes is inserted into the pocket 21 and directed along a circular path by the wrapping wheel 22, in familiar fashion, the leaf 11 of material is folded gradually into a tube around the group 2, with two free edges overlapping along the flank of the group facing radially outwards.

Figure 1A:
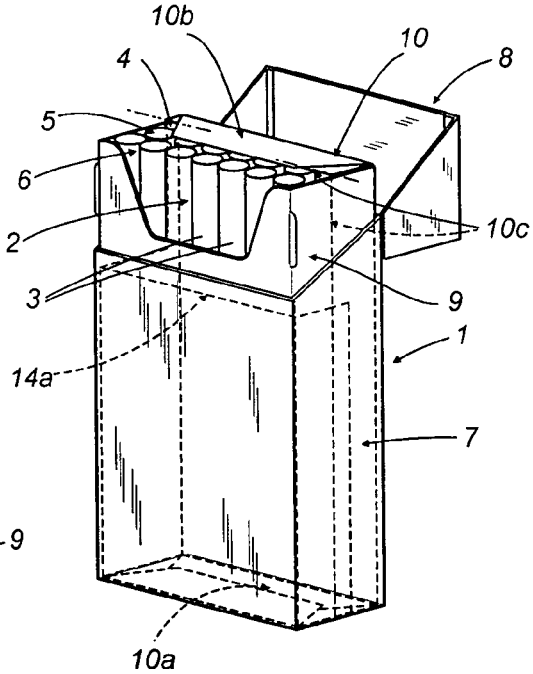
Figure 1B:
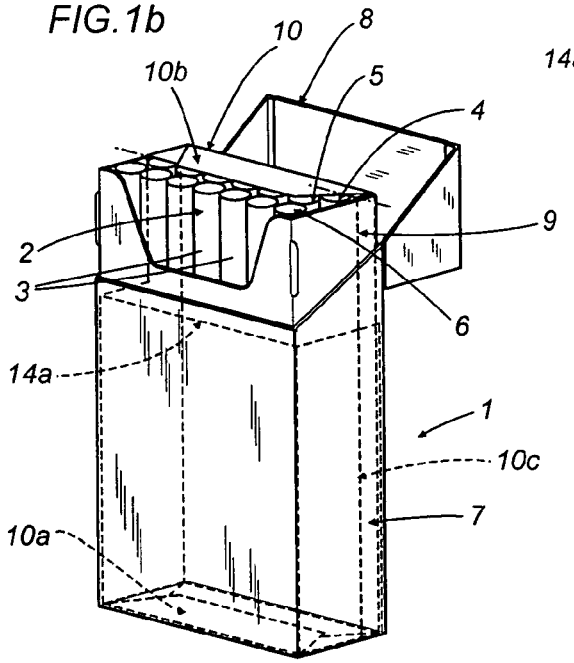

The two ends of the tubular wrap thus formed, which project beyond the ends of the cigarettes 3, are folded in and flattened likewise during the rotation of the wheel 22 to form the bottom end face 10*a* and the top end face 10*b* of the inner wrapper 10 (FIGS. 1, 1*a* and 1*b*). Observing the inner wrapper 10, the removable or pull portion 16 covers a front and an end part of the forwardmost row 6 of cigarettes 3 and is positioned in such a manner that the edge 16*a* created by the transverse tear-off line 15 is aligned, in a plane parallel to the rear wall of the cupped body 7, with a free edge 10*c* of the inner wrapper 10, and more exactly with the edge 10*c* created by the transverse cut 34 made through the strip 12, as discernible from FIGS. 1, 1*a* and 1*b*.

The strip 12 is decoiled from the roll 12*a* and drawn initially over a first diverting roller 23 by feed means consisting in a pair of pinch rolls 24 rotatable substantially tangential one to another about mutually parallel axes.

The strip 12 is directed by the rolls 24 along a predetermined feed path P toward a cutter device, denoted 25 in its entirety, which comprises a first roller 26 set in rotation at constant speed about a relative horizontal axis 26*a*, turning counter-clockwise as viewed in FIG. 2, and furnished around its surface of revolution with holes 27 connected to a source of negative pressure (not illustrated) for reasons that will become clear in due course.

The first roller 26 carries a first blade 28 and a second blade 29 occupying diametrically opposed positions, each extending substantially parallel to the axis of rotation 26*a* and proportioned so as not to project radially above the surface of revolution of the roller 26.

The cutter device 25 further comprises a second roller 30 rotatable in the opposite direction to the first roller 26 about an axis 30*a* parallel to the axis 26*a* first mentioned, and equipped with a first blade 31 and a second blade 32 diametrically opposed and extending substantially parallel to the axis 30*a* of rotation which in this instance project above the surface of revolution of the roller 30.

The angular velocities and the timing of the two rollers 26 and 30 are controlled in such a way that the first blades 28 and 31 of the first and second rollers 26 and 30 will constitute first transverse cutting means by which to separate single sheets 11 from the strip 12 along dividing lines denoted 34 in FIG. 4, whilst the second blades 29 and 32 of the first and second rollers 26 and 30 constitute second cutting means such as will generate the aforementioned transverse tear-off lines 15 (see FIG. 4).

The two rollers 26 and 30 combine at an area of substantially tangential proximity to establish a cutting zone 33 occupiable, in particular, by the first and second cutting means.

It will be seen that the length of the two first blades 28 and 31, measured parallel to the axis of rotation 26*a*, is substantially equal to the width of the strip 12, whilst the length of the second blades 29 and 32, measured parallel to the selfsame axis 26*a*, is substantially equal to the length of the transverse tear-off lines 15.

35 denotes third cutting means located downstream of the second roller 30 and consisting in a disc cutter 36 rotatable clockwise, at the same speed as the first roller 26, about an axis 36*a* parallel to the axis 26*a* of the selfsame first roller.

The disc cutter 36 engages in a circumferential track 37 afforded by the first roller 26 and serves to impress the aforementioned longitudinal tear-off lines 14, which will combine with the transverse tear-off lines 15 to delineate the removable pull portions 16 on the strip.

The track 37 presents a portion of minimal depth, occupying a predetermined portion of length equal to the length of the longitudinal tear-off line 14, along which the recessed cylindrical face provides a reaction surface offered to the disc cutter 36, whilst the depth of the remaining portion is such that no contact will be made with the cutter 36.

The single leaves 11 advance beyond the third cutting means, each presenting longitudinal and transverse tear-off lines 14 and 15 and retained by suction on the first roller 26, and are directed into a transfer station 38 positioned diametrically opposite to the cutting zone 33.

Figure 3:
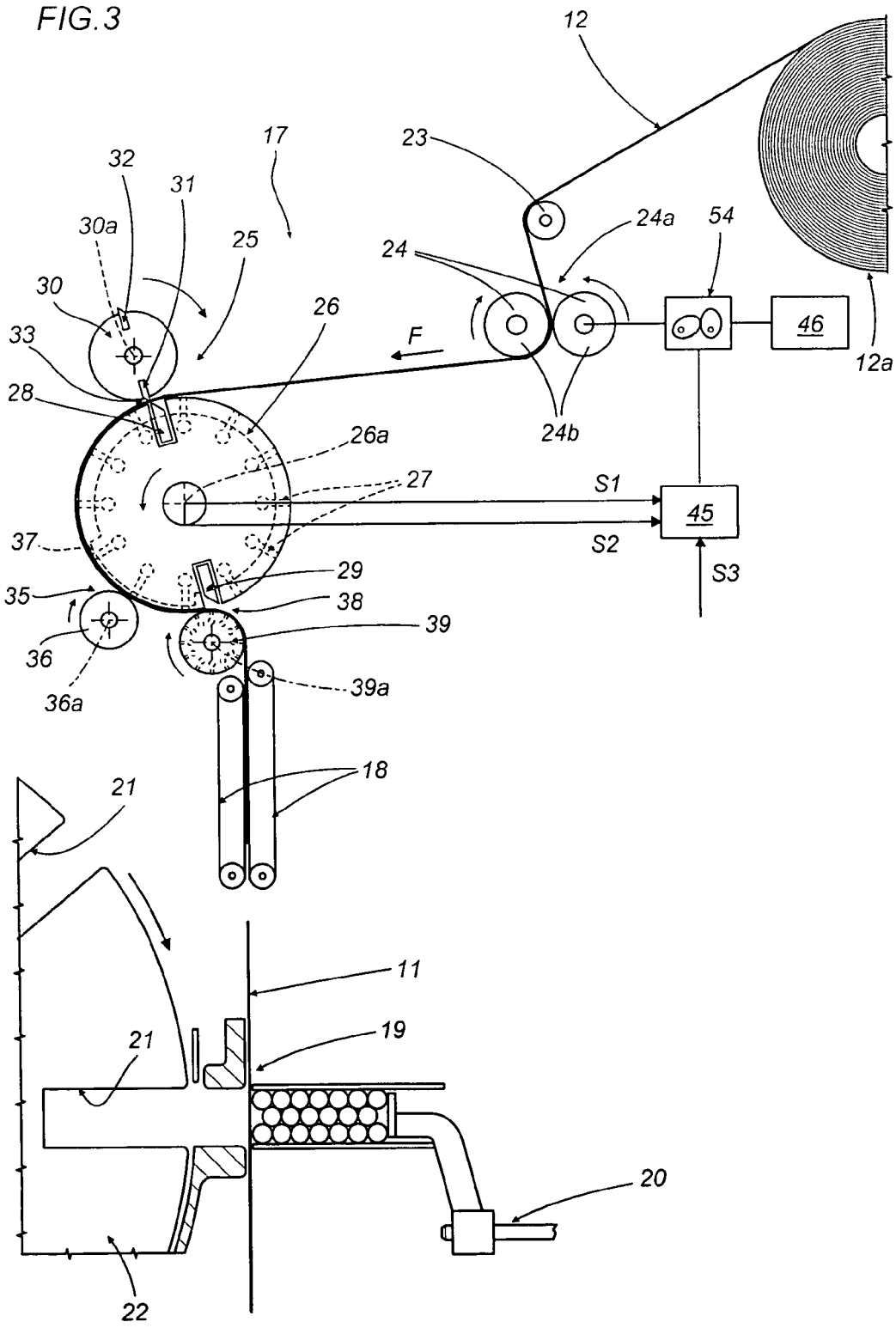
FIG. 3 shows a second embodiment of the unit as in FIG. 2, viewed in a schematic elevation and partly as a block diagram, with certain parts in section and others omitted.

On reaching the transfer station 38, each leaf 11 is taken up by a suction roller 39 set in rotation about an axis 39*a* parallel to the axis 26*a* of the first roller 26, turning in a clockwise direction substantially tangential to this same roller 26, and transferred to the aforementioned belts 18 of the feed and guide means, represented schematically in FIGS. 2 and 3.

The unit further comprises pivotable diverter means 40 located along the feed path P upstream of the cutting zone 33, preceding the cutting zone 33 and following the pinch rolls 24, and interacting with the running strip 12 in such a way as to vary the length of the path P according to the operating frequency of the second cutting means.

The diverter means 40 comprise an arm 41 of which one end is anchored pivotably to a mounting 42 and the other end carries a roller 43 placed in contact with the strip 12. The arm 41 can be swung between two limit positions, one of which indicated in bold lines and the other in phantom lines (see FIG. 2) through the agency of actuator means 44 interlocked to a control unit 45 in receipt of input signals S1 and S2 indicating the angular velocity and angular position, respectively, of the first roller 26.

The operation of the unit will now be described, departing from a situation in which the downstream machine requires leaves 11 of wrapping material with the transverse tear-off line 15 occupying a substantially intermediate position, denoted 15 in FIG. 4, relative to the transverse lines 34 along which the strip 12 is cut.

In this situation, the pivoting arm 41 of the diverter means 40 is set in a predetermined fixed position and the roller 43 placed so as to divert the strip 12 along a path denoted P0, indicated by a dash-dot phantom line in FIG. 2.

In the event that, for the reasons explained in the preamble, it should become necessary to adjust the position of the transverse tear-off lines 15 in relation to the transverse cut lines 34, so as to bring the edge 16*a* created by the tear-off line 15 into alignment with the longitudinal edge 10*c* of the inner wrapper 10 generated by the transverse cut 34, in a plane not parallel to the rear wall of the cupped body 7, as illustrated in FIGS. 1*a* and 1*b*, then a corrective action is required.

As illustrated in FIGS. 1, 1*a* and 1*b* of the drawings, 16*a* denotes the vertical edge common to the pull portion 16 and the inner wrapper 10, generated by the transverse tear-off line 15, whilst 14*a* denotes the horizontal edge common to the pull portion 16 and the inner wrapper 10, generated by the longitudinal tear-off line 14.

The corrective action can be generated manually or automatically and is induced by transmitting an input signal S3 to the control unit 45 such as will restore the correct position of the removable or pull portion 16.

Assuming one operating cycle to consist in a rotation of 360° completed by the first roller 26 between two successive cutting strokes, resulting in the separation of one leaf 11 from the strip 12, the correct position is restored by inducing a cyclical variation in the length of the path P followed by the strip between the pinch rolls 24 and the cutting zone 33, through the agency of the diverter means 40.

More particularly, as illustrated in FIGS. 2 and 4, and referring to the feed direction F of the strip 12, should it become necessary to shift the transverse tear-off line to a position further downstream and thus reduce the length of the pull portion 16 parallel with the longitudinal axis 13 of the strip, the arm 41 will be repositioned in such a manner as to divert the strip 12 along a path P1 longer than the path denoted P0, thereby advancing the tear-off line impressed by the second blades 29 and 32, as indicated by numeral 15*a*.

Conversely, if the intention is to shift the position of the transverse tear-off line upstream relative to the feed direction F of the strip 12 as indicated by numeral 15*b*, thereby increasing the length of the pull portion 16, then the arm 41 will be repositioned in such a manner as to divert the strip 12 along a path P2 shorter than the path denoted P0.

The adjustment in question produces a periodic variation in the linear speed of the strip 12 relative to the peripheral speed of the roller 26, with the strip effectively slipping on the surface of the roller 26.

It will be seen that the variation in speed has an effect only on the positioning of the transverse tear-off line 15, and accordingly, causing the diverter means 40 to act on the strip 12 in the course of each cycle is equivalent to adjusting the timing of the cutting stroke made by the second blades 29 and 32, and consequently the position of the transverse tear-off line 15.

In the example of FIG. 3, the variation in the timing of the cut made by the second blades 29 and 32 during each cycle, and therefore the adjustment in the position of the tear-off line 15, is brought about by applying a cyclical variation to the speed of rotation of the pinch rolls 24, which will thus perform the function of control means denoted 24*a* in FIG. 3.

The variation is induced by activating a drive component, connected to at least one of the two rolls 24 and indicated schematically as a block 46 in FIG. 3, of which the operation is piloted by a signal received from the control unit 45 in the same way as described previously. Alternatively, mechanical transmission means of conventional type might be interposed between one of the rolls 24 and the drive component 46, such as will vary the speed of rotation of the pinch rolls 24 during the cycle. The mechanical transmission means in question might consist for example in eccentric gears, denoted 54 and indicated schematically in FIG. 3, that is to say gears with a transmission ratio that does not remain constant during the cycle. The pinch roll 24 not connected to the drive component will naturally be coupled to the live roll 24.

It will be seen that the decoiling pinch rolls 24 in all of the various embodiments illustrated might consist in embossing rollers, denoted 24*b*, and that in the example of FIG. 3, more particularly, the embossing rollers 24*b* are one and the same as the control means 24*a*.

Figure 5:
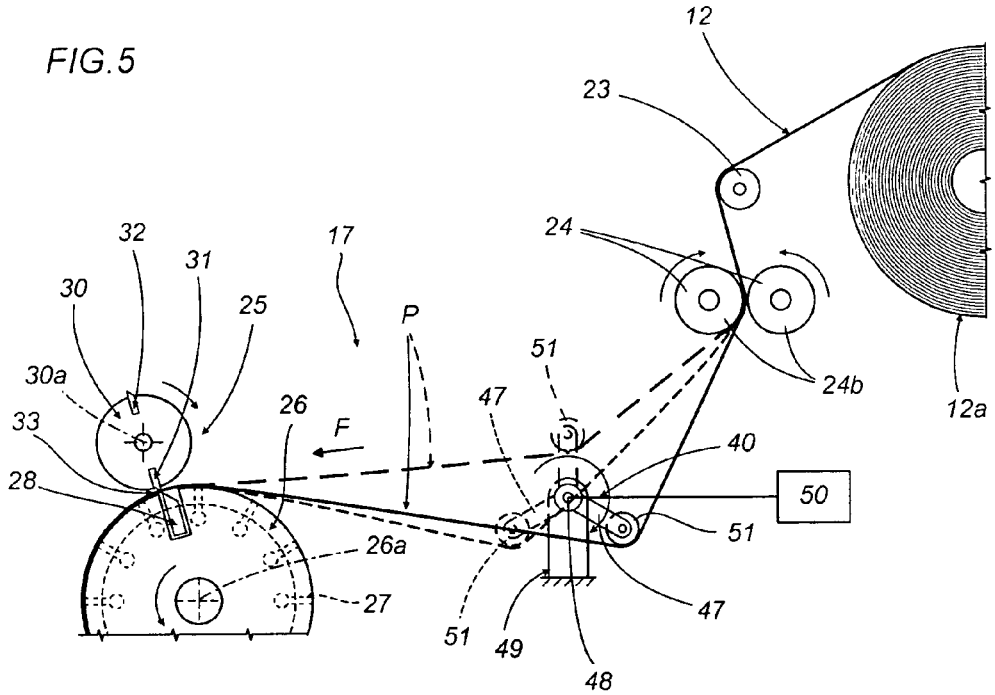
FIGS. 5 and 6 illustrate a detail of FIG. 2 shown in two different embodiments, both viewed schematically and in elevation.

In the example of FIG. 5, the pivoting diverter means 40 consist in a rotary component comprising an arm 47 set in rotation about a fulcrum pivot 48 afforded by a mounting 49, through the agency of respective actuator means 50. The free end of such an arm 47 carries an idle diverter roller 51 which, when set in rotation at machine speed, will induce cyclical variations in the length of the path P followed by the strip 12.

Figure 6:
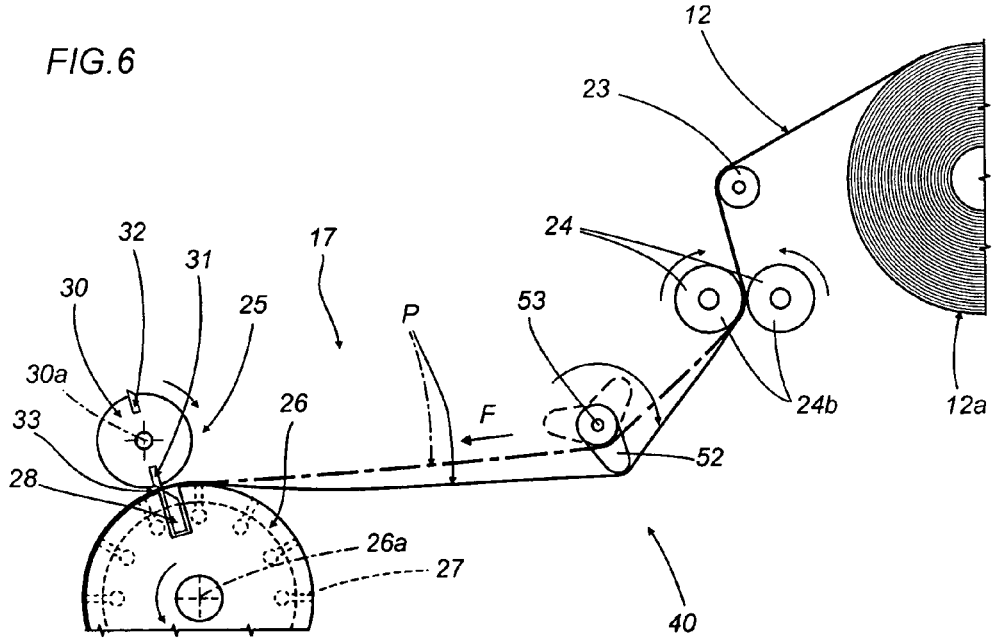

In the example of FIG. 6, the diverter means 40 consist in a cam 52 rotatable about a respective fulcrum pivot 53 in such a way as to bring about cyclical variations in the length of the path P followed by the strip 12.

In all of the examples illustrated in FIGS. 2, 3, 5 and 6, the pinch rolls 24 might consist in embossing rollers; moreover, in the light of the foregoing description, both the diverter means 40 and the pinch rolls 24 or the embossing rollers 24*b* are identifiable as means serving to control the timing of the cut made by the second cutting means and at the same time as means serving to introduce a cyclical variation in the relative speeds of the strip 12 and the second cutting means.

Finally, it will be observed that the position of the transverse tear-off lines 15*a* and 15*b* can be controlled by varying the amplitude and frequency of the movement described by the arm 41, in the case of the embodiment illustrated in FIG. 2, or by varying the timing and/or amplitude and/or frequency of the movements generated in the arm 47 or the cam 52, in the case of the embodiments illustrated in FIGS. 5 and 6 respectively.

What is claimed:

1. A unit for feeding and cuffing into lengths a strip of wrapping material, applicable to a cigarette packer, comprising:

a cutter device comprising a first roller and a second roller, rotatable in an opposite direction to the first roller; the first roller having a first blade and a second blade occupying diametrically opposed positions, the second roller having a first blade and a second blade occupying diametrically opposed positions; the first and the second rollers combining at an area of substantially tangential proximity to establish a cutting zone that can be occupied alternatively by the first blades of the first and the second rollers and by the second blades of the first and the second rollers; the first blades, being cyclical in operation, for dividing the strip transversely into single leaves of predetermined length and the second blades being cyclical in operation, for impressing at least one transverse tear-off line on each leaf;

control means for controlling a timing of a stroke of the second blades relative to the strip, between each two successive transverse dividing strokes made through the strip, so as to adjust a position of the transverse tear-off line on the leaf;

wherein the first roller and the second roller rotate at a constant angular speed and the strip wraps around and engages a circumferential surface portion of one of the first roller and the second roller, and wherein the control means, acting directly on the strip, produces a periodic variation in a linear speed of the strip relative to a peripheral speed of the roller around which the strip wraps to cause the strip to slip on the circumferential surface of that roller for cyclically controlling a position of the strip with respect to the second blades before reaching the cutting zone.

2. A unit as in claim 1, comprising feed means for feeding the strip along a predetermined path toward the first and second blades.

3. A unit as in claim 2, wherein the control means comprise means interacting with the strip upstream of the first and second blades, for periodically controlling the linear speed of the strip.

4. A unit as in claim 3, wherein the control means are one and the same as the feed means.

5. A unit as in claim 3, wherein the feed means include two embossing rollers.

6. A unit as in claim 5, wherein the cyclical control means are set in motion by respective drive means coupled to respective interposed mechanical transmission means of which a transmission ratio does not remain constant during a course of the operating cycle.

7. A unit as in claim 4, wherein the cyclical control means are set in motion by respective drive means coupled to respective interposed mechanical transmission means of which a transmission ratio does not remain constant during a course of the operating cycle.

8. A unit as in claim 4, further comprising third cutting means for impressing a longitudinal tear-off line on the strip such as will combine with a relative transverse tear-off line to delimit a removable portion of the leaf.

9. A unit as in claim 3, further comprising third cutting means for impressing a longitudinal tear-off line on the strip such as will combine with a relative transverse tear-off line to delimit a removable portion of the leaf.

10. A unit as in claim 2, wherein the control means interact with the strip at a given point along the predetermined path located between the feed means and a cutting zone occupied by the first and second blades.

11. A unit as in claim 10, wherein the control means include pivotable diverter means capable of varying a length of the predetermined path between the feed means and the cutting zone.

12. A unit as in claim 10, wherein the control means comprise a rotary component including an arm rotatable about a fulcrum pivot, of which a free end carries an idle roller that, in the course of its rotation, induces cyclical variations in a length of the path followed by the strip.

13. A unit as in claim 10, wherein the control means comprise a rotary component including a cam rotatable about a fulcrum pivot in such a way as to induce cyclical variations in a length of the path followed by the strip.

14. A unit as in claim 10, further comprising third cutting means for impressing a longitudinal tear-off line on the strip such as will combine with a relative transverse tear-off line to delimit a removable portion of the leaf.

15. A unit as in claim 2, wherein the control means interact with the strip at a given point along the predetermined path located between the feed means and the cutting zone.

16. A unit as in claim 2, further comprising third cutting means for impressing a longitudinal tear-off line on the strip such as will combine with a relative transverse tear-off line to delimit a removable portion of the leaf.

17. A unit as in claim 1, further comprising third cutting means serving to impress a longitudinal tear-off line on the strip such as will combine with a relative transverse tear-off line to delimit a removable portion of the leaf.

18. A unit as in claim 1, wherein the control means comprise means interacting with the strip upstream of the first and the second blades, for periodically controlling the linear speed of the strip.

19. A unit as in claim 1, wherein the control means comprise eccentric gears for cyclically controlling a position of the strip.

20. A unit as in claim 1, wherein the blades of the roller around which the strip wraps and slips are positioned so as to be completely retained beneath the circumferential surface of that roller, and the blades of the other roller are positioned to project above a circumferential surface of revolution of the other roller.

* * * * *